US007131421B2

(12) United States Patent
Hada et al.

(10) Patent No.: US 7,131,421 B2
(45) Date of Patent: Nov. 7, 2006

(54) OIL PAN OF INTERNAL COMBUSTION ENGINE

(75) Inventors: Masatoshi Hada, Nagoya (JP); Yasuki Ohta, Nagoya (JP)

(73) Assignee: Aichi Machine Industry Co., Ltd, Nagoya (JP)

( * ) Notice: Subject to any disclaimer, the term of this patent is extended or adjusted under 35 U.S.C. 154(b) by 0 days.

(21) Appl. No.: 11/150,319

(22) Filed: Jun. 13, 2005

(65) Prior Publication Data

US 2006/0118077 A1 Jun. 8, 2006

(30) Foreign Application Priority Data

Dec. 7, 2004 (JP) ..... 2004-205316

(51) Int. Cl.
*F01M 1/02* (2006.01)
*F01M 3/00* (2006.01)
*F01M 1/04* (2006.01)

(52) U.S. Cl. ..... 123/196 R; 184/6.2; 184/6.5; 184/6.13

(58) Field of Classification Search ..... 123/196 R, 123/195 C; 184/6.2, 6.5, 6.8, 6.9, 6.13
See application file for complete search history.

(56) References Cited

U.S. PATENT DOCUMENTS 6,889,651 B1 * 5/2005 Tanaka et al. ..... 123/196 R

FOREIGN PATENT DOCUMENTS

JP 4-71716 6/1992

* cited by examiner

*Primary Examiner*—Noah P. Kamen
(74) *Attorney, Agent, or Firm*—Dennison, Schultz & MacDonald

(57) ABSTRACT

The oil pan includes an oil introducing portion that has an oil introducing plate. The oil introducing plate has an insertion hole for receiving a sucking portion of an oil strainer. The oil introducing plate extends from the periphery of the insertion hole toward a side wall of the oil pan. The oil returned from the first oil return passage is introduced to flow along the oil introducing plate via an oil falling hole formed in a baffle plate that is positioned at the bottom of a crank case of the internal combustion engine. The oil introducing portion further includes a plurality of inclined wall portions mounted on a bottom portion of the oil pan in the vicinity of the side wall of the oil pan in order to support the oil introducing plate. Opening portions are formed between the inclined wall portions and the bottom portion of the oil pan. The oil introducing plate of the oil introducing portion is located just below the oil falling hole formed in said baffle plate.

4 Claims, 3 Drawing Sheets

OIL PAN OF INTERNAL COMBUSTION ENGINE

BACKGROUND OF THE INVENTION

1. Field of the Invention

The present invention relates to an oil pan of an internal combustion engine.

2. Description of the Related Art

Oil for lubricating respective sliding portions of an internal combustion engine is deposited in the oil pan of the internal combustion engine and supplied to those respective sliding portions of the internal combustion engine by means of an oil pump and the like through an oil strainer.

After lubricating a sliding surface between a cylinder and a piston and bearings of a connecting rod and crank shaft of the sliding portions of the internal combustion engine, oil floats in the condition of mist within a crank case. The oil is heated by a high-temperature blow-by gas leaking from the sliding surface between the cylinder and the piston, drops onto a baffle plate, and thereafter returns to the oil pan.

As regards the internal combustion engine, for example, Japanese Utility Model Application Laid-Open NO.HEI4-71716 discloses a structure for preventing the oil strainer from being exposed over the oil surface and sucking air due to the tilt of the oil surface generated at the time of acceleration or deceleration for startup or stop of a vehicle or turning. Therefore, the oil is stably supplied to the respective sliding portions of the internal combustion engine, thereby improving wear resistance.

According to the structure disclosed in this document, a lidded cylindrical baffle plate for defining an oil holding space to surround the oil strainer is provided on an oil sump within the oil pan. This lidded cylindrical baffle plate has a communicating opening hole which communicates with the interior of the oil pan. The oil strainer is inserted into the communicating opening at its lid portion. A dent portion which communicates with the interior of the oil pan is formed at the bottom of this cylindrical body. Consequently, by holding a sufficient amount of oil within the oil holding space by this cylindrical body, oil can be supplied to the respective sliding portions of the internal combustion engine stably even when the oil surface is tilted.

However, the structure of such oil pan allows hot oil recovered after floating within the crank case to enter into the oil holding space through the communicating opening hole formed in the lid portion on the top of the baffle plate. Consequently, the hot oil is supplied to the respective sliding portions of the internal combustion engine from the oil strainer, thereby possibly badly affecting the lubrication performance.

SUMMARY OF THE INVENTION

The oil pan of the internal combustion engine of the present invention intends to prevent a drop in the viscosity of oil and deterioration of the oil to improve the lubrication performance thereof by cooling the oil within the oil pan to equalize the temperature of the oil.

According to a first aspect of the present invention, an oil pan collects oil returned from a first oil return passage and oil returned from a second oil return passage of an internal combustion engine. The first oil return passage extends from a cylinder head to an oil pan through a crank case and a baffle plate disposed at a bottom of the crank case. The second oil return passage extends directly from the cylinder head to the oil pan.

The oil pan includes an oil introducing portion that has an oil introducing plate. The oil introducing plate has an insertion hole for receiving a sucking portion of an oil strainer. The oil introducing plate extends from the periphery of the insertion hole toward a side wall of the oil pan. The oil returned from the first oil return passage is introduced to flow along the oil introducing plate via an oil falling hole formed in a baffle plate that is positioned at the bottom of a crank case of the internal combustion engine. The oil introducing portion further includes a plurality of inclined wall portions mounted on a bottom portion of the oil pan in the vicinity of the side wall of the oil pan in order to support the oil introducing plate. Opening portions are formed between the inclined wall portions and the bottom portion of the oil pan. The oil introducing plate of the oil introducing portion is located just below the oil falling hole formed in said baffle plate.

As a consequence, hot oil flowing down from the first oil return passage is introduced to the side wall of the oil pan along the oil introducing plate of the oil introducing portion. The oil can be cooled excellently by the side wall of the oil pan which keeps in contact with the atmosphere. Further, by introducing oil toward the side wall, the entire oil within the oil pan is circulated, thereby eliminating an oil retaining zone in the oil pan. Further, the temperature of the oil in the oil pan is equalized excellently and that oil is introduced to the sucking portion of the oil strainer through the opening portions in the inclined wall portions of the oil introducing portion. Therefore, the oil can be supplied to respective portions of the internal combustion engine excellently. As a result, a drop in the viscosity of the oil and deterioration of the oil can be prevented.

The oil introducing portion is provided on the bottom of the oil pan. The oil introducing plate contains the insertion hole through which the sucking portion of the oil strainer is inserted. Therefore, the oil introducing portion can be fixed on the bottom of the oil pan excellently and further, the oil strainer can be installed on the oil introducing portion compactly.

According to a second aspect of the present invention, the oil introducing portion further includes sheet-like extensions extending from the inclined wall portions at respective top ends of the opening portions.

Therefore, hot oil flowing down from the first oil return passage runs over a long distance along the sheet-like extensions before introduced to the side wall of the oil pan excellently. As a consequence, fluidity of the oil in the oil pan is improved thereby eliminating the oil retaining zone. Further, by feeding oil along the side wall of the oil pan, active radiation of heat to the atmosphere is enabled.

According to a third aspect of the present invention, the second oil return passage is open at a bottom end that is submerged in the oil collected within the oil pan. A part of each of said opening portions is open toward the bottom end of the second oil return passage.

Hot oil flowing down from the first oil return passage runs to the side wall of the oil pan along the oil introducing plate of the oil introducing portion. The oil is cooled by the side wall and is then introduced to the sucking portion of the oil strainer through the opening portion in the oil introducing portion. At this time, cooled oil introduced from the cylinder head flows down from the bottom end of the second oil return passage into the oil pan and then flows toward the opening portion of the oil introducing portion. As a consequence, hot oil and cooled oil flowing down from the second oil return passage are mixed excellently so as to equalize. Therefore, the temperature of entire oil in the oil pan is lowered. Further, due to the mixing of the hot oil and the cooled oil, a positive tide is generated in the entire oil within the oil pan, so that oil retaining zone in the oil pan diminishes and consequently, the temperature of the oil can be equalized further excellently.

DESCRIPTION OF THE PREFERRED EMBODIMENTS

Hereinafter, a preferred embodiment of the present invention will be described with reference to the accompanying drawings.

Figure 1:
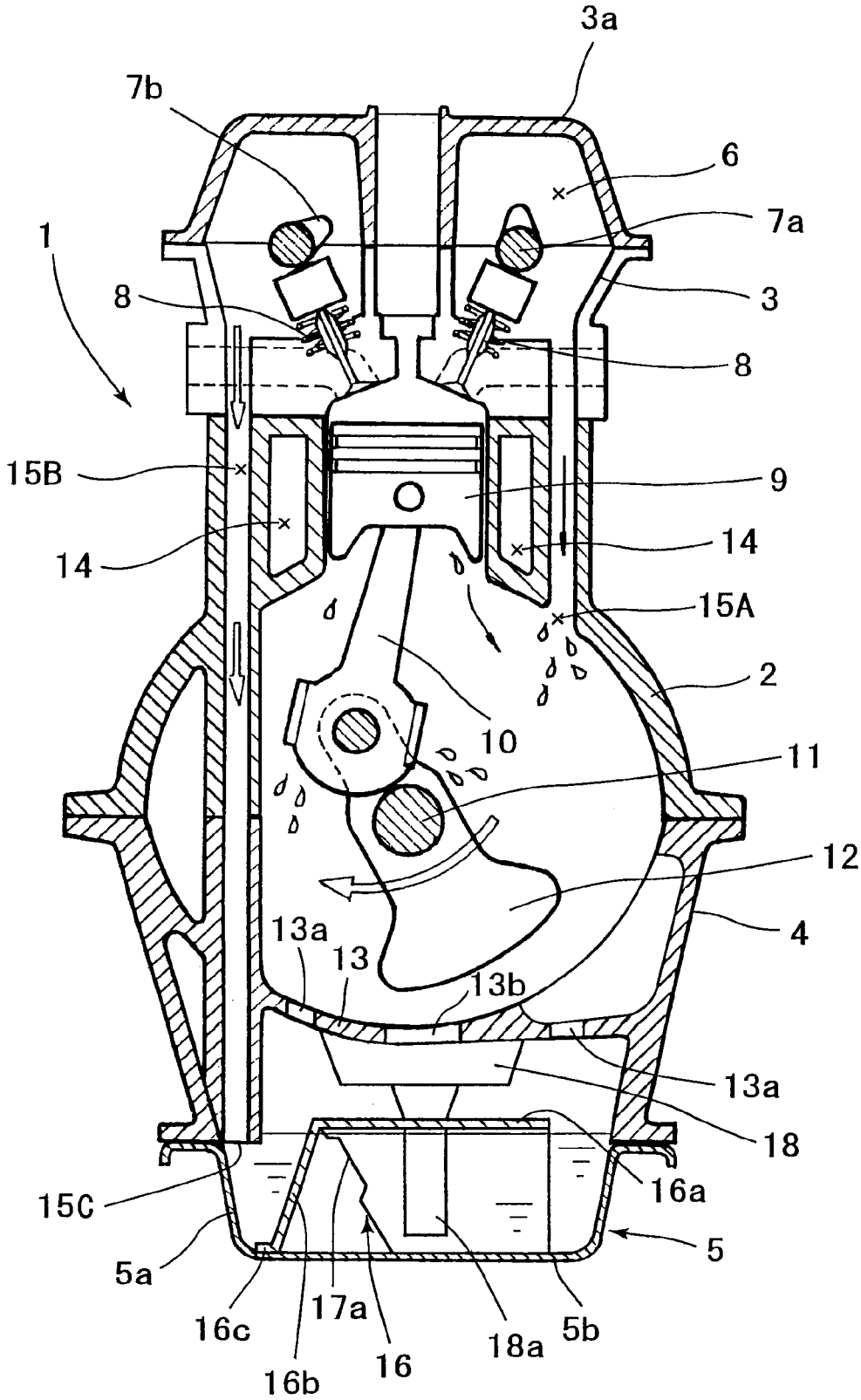
FIG. 1 is a schematic longitudinal sectional view of the internal combustion engine.

FIG. 1 is a longitudinal sectional view of an internal combustion engine. In the internal combustion engine 1, a cylinder head 3 is provided on the top of a cylinder block 2. A crank case 4 is connected to the bottom of the cylinder block 2. An oil pan 5 for collecting oil is provided below the crank case 4.

A head cover 3*a* is mounted on the top of the cylinder head 3 to cover valve driving parts including cam shafts 7*a*, cams 7*b* and valve springs 8 provided within the cylinder head 3. The cylinder head 3 and the head cover 3*a* define a cam chamber 6.

A piston 9 and a connecting rod 10 are provided within the cylinder block 2. A crank shaft 11 and a counterweight 12 are provided within the crank case 4. As the internal combustion engine operates, the counterweight 12 rotates in the direction indicated with an arrow.

A curved baffle plate 13 extends along a rotary trajectory of the counterweight 12 of the crank shaft 11 on the bottom of the crank case 4. Oil lubricates the sliding surface between the cylinder and piston. Also, oil lubricates the valve driving parts including the cam shaft 7*a*, the cam 7*b* and the valve spring 8 located on one side of the cylinder head 3. These lubricated oils drop into the crank case, thereby lubricating the connecting rod 10, the crank shaft 11 and the like. Thereafter, the oils return into the oil pan 5 located below through oil falling holes 13*a*, 13*a*, 13*b* formed in the baffle plate 13. In this way, a first oil return passage 15A is defined.

Further, a water jacket 14, in which cooling water for cooling the cylinder flows, is provided sideway of the piston 9 within the cylinder block 2. A second oil return passage 15B is formed vertically on the outer periphery side of that water jacket 14.

This second oil return passage 15B is defined in the cylinder head 3, the cylinder block 2 and the crank case 4. Oil returns to the oil pan 5 via the second oil return passage 15*b* after lubricating the valve driving parts including the cam shaft 7*a*, the cam 7*b* and the valve spring 8 located on the other side of the cylinder head 3. The second oil return passage 15*b* is formed in the vertical direction of the internal combustion engine. A bottom end opening portion 15C of the second oil return passage 15B is located at a position submerged in the oil collected within the oil pan 5.

The oil that returns to the oil pan 5 through the second oil return passage 15B is cooled by cooling water flowing through the water jacket 14 in the halfway of the returning path. Therefore, the temperature of the oil is lowered before returning into the oil pan 5.

On the other hand, within the crank case 4 defining the first oil return passage 15A, the connecting rod 10 and the crank shaft 11 are lubricated by the oil that has lubricated the sliding surface between the cylinder and the piston 9 and by the oil that has lubricated the valve driving parts including the cam shaft 7*a*, the cam 7*b* and the valve spring 8 located on the one side of the cylinder head 3. At the same time, the oils are splashed by the connecting rod 10, the counterweight 12 and the like, which rotate at high speeds when the internal combustion engine is operated. Therefore, the oil turns into mist whose surface area per unit volume is large, thereby increasing the quantity of heat received from hot blow-by gas leaking from the sliding surface between the cylinder and the piston 9. As a consequence, the temperature of the mist gas is kept high. This hot oil is returned to the oil pan 5 through the oil falling holes 13*a*, 13*b* in the baffle plate 13 as described previously.

Figure 2:
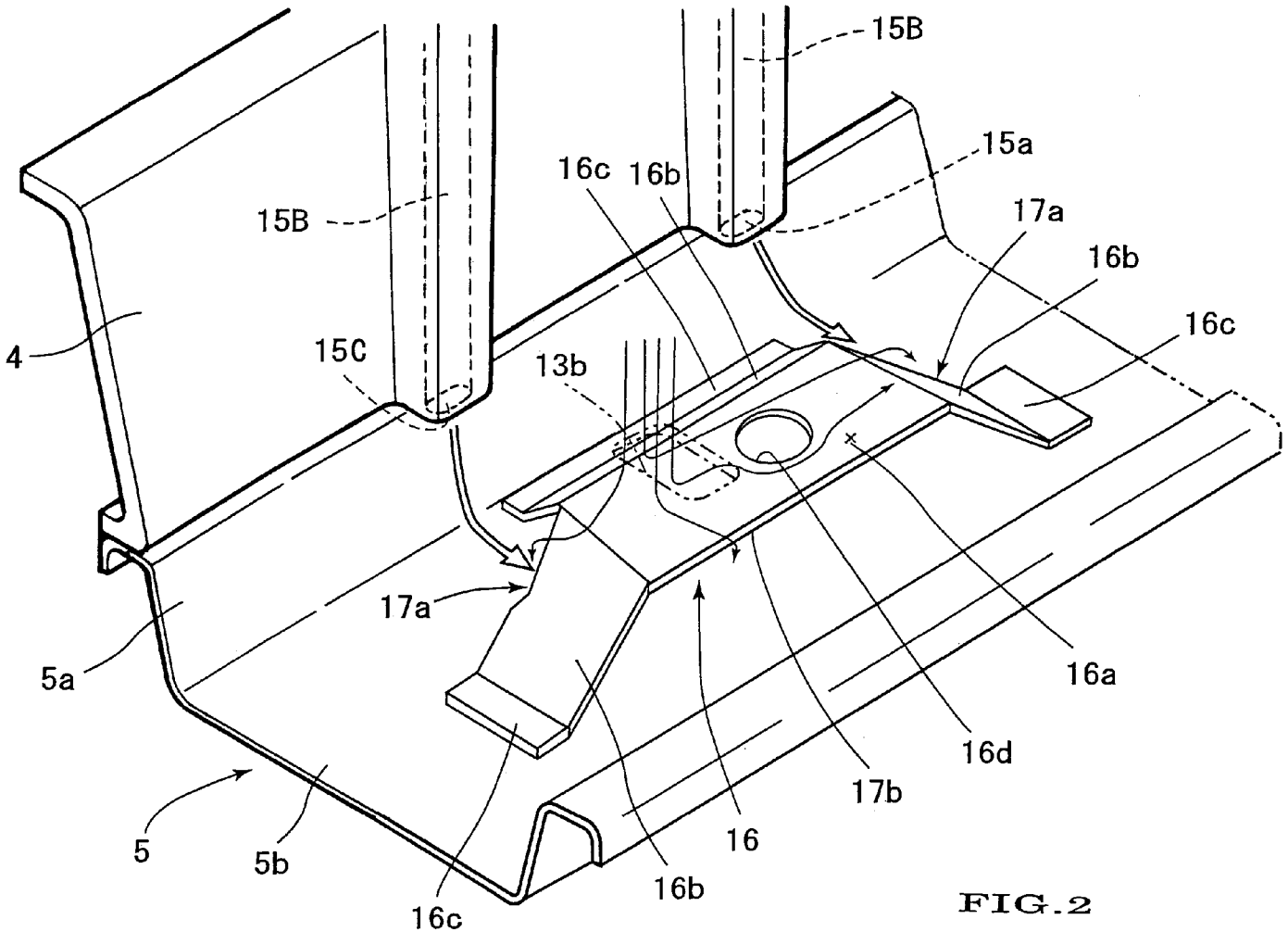
FIG. 2 is an enlarged perspective view of major portions in case where an oil introducing portion is provided within an oil pan of the internal combustion engine.

According to this embodiment, as shown in the enlarged perspective view of major portions of FIG. 2, an oil introducing portion 16 is provided within the oil pan 5.

The oil introducing portion 16 is fixed on a bottom wall 5*b* of the oil pan 5 and includes an oil introducing plate 16*a*, inclined wall portions 16*b* and fixing pieces 16*c* to be fixed on the bottom wall 5*b* of the oil pan 5. The center of the oil introducing plate 16*a* has an insertion hole 16*d* in which an oil strainer 18 is to be installed.

A sucking portion 18*a* is located at a bottom end of an oil strainer 18 and is inserted through the insertion hole 16*d* in the center of the oil introducing plate 16. The sucking portion 18*a* is disposed in the vicinity of the bottom wall 5*b* of the oil pan 5 located below. An oil passage for feeding oil to an oil pump (not shown) is provided in the top face of the oil strainer 18.

Therefore, the oil introducing portion 16 surrounds the sucking portion 18*a* of the oil strainer 18. The oil introducing plate 16*a* of this oil introducing portion 16 extends from the periphery of the insertion hole 16*d* toward the side wall of the oil pan so as to be positioned just below the oil falling hole 13*b* located at the lowest position of the baffle plate 13.

That is, hot oil flows down on this oil introducing plate 16*a* through the oil falling holes 13*a*, 13*a*, 13*b* in the baffle plate 13 and then smoothly flows along the oil introducing plate 16 toward the outer peripheral side or toward the side wall 5*a* of the oil pan 5.

Further, drain side opening portions 17*a* are formed in the inclined wall portion 16*b* of the oil introducing portion 16 and are directed to the bottom end opening 15C of the second oil return passage 15B. Preferably, the drain side opening portions 17*a* are formed in the vicinity of the bottom end opening 15C of the second oil return passage 15B.

In the inclined wall portion 16*b*, a rear side opening portion 17*b* is formed on an opposite side to the drain side opening portion 17*a*.

Thus, cooled oil flows out from the bottom end opening 15C through the second oil return passage 15B and can flow into the oil introducing portion 16 through the drain side opening portions 17*a*.

Hot oil dropping on the oil introducing plate 16*a* of the oil introducing portion 16 flows to the side wall 5*a* of the oil pan 5 along the oil introducing plate 16*a*. Because the side wall 5*a* of this oil pan 5 keeps contact with the atmosphere, while hot oil flows to the bottom wall 5*b* along the side wall 5*a*, heat is radiated excellently to the atmosphere so that the temperature of oil is reduced. With the temperature dropping gradually, the oil flows into the oil introducing portion 16 through the drain side opening portion 17*a* and the rear side opening portion 17*b*.

At this time, cooled oil flowing down from the second oil return passage 15B is mixed with hot oil excellently so that the entire temperature of oil within the oil pan 5 is equalized. Further, positive tides is generated in oil within the oil pan 5 due to the mixing of high temperature and low temperature oils, thereby eliminating oil retaining zone within the oil pan 5. Consequently, with the temperature of entire oil in the oil pan 5 dropped, the oil can be supplied to respective portions of the internal combustion engine 1 from the sucking portion 18*a* of the oil strainer 18. As a result, drop in the viscosity of oil can be prevented and deterioration of oil can be blocked, so that excellent lubrication performance with oil is secured.

Figure 3:
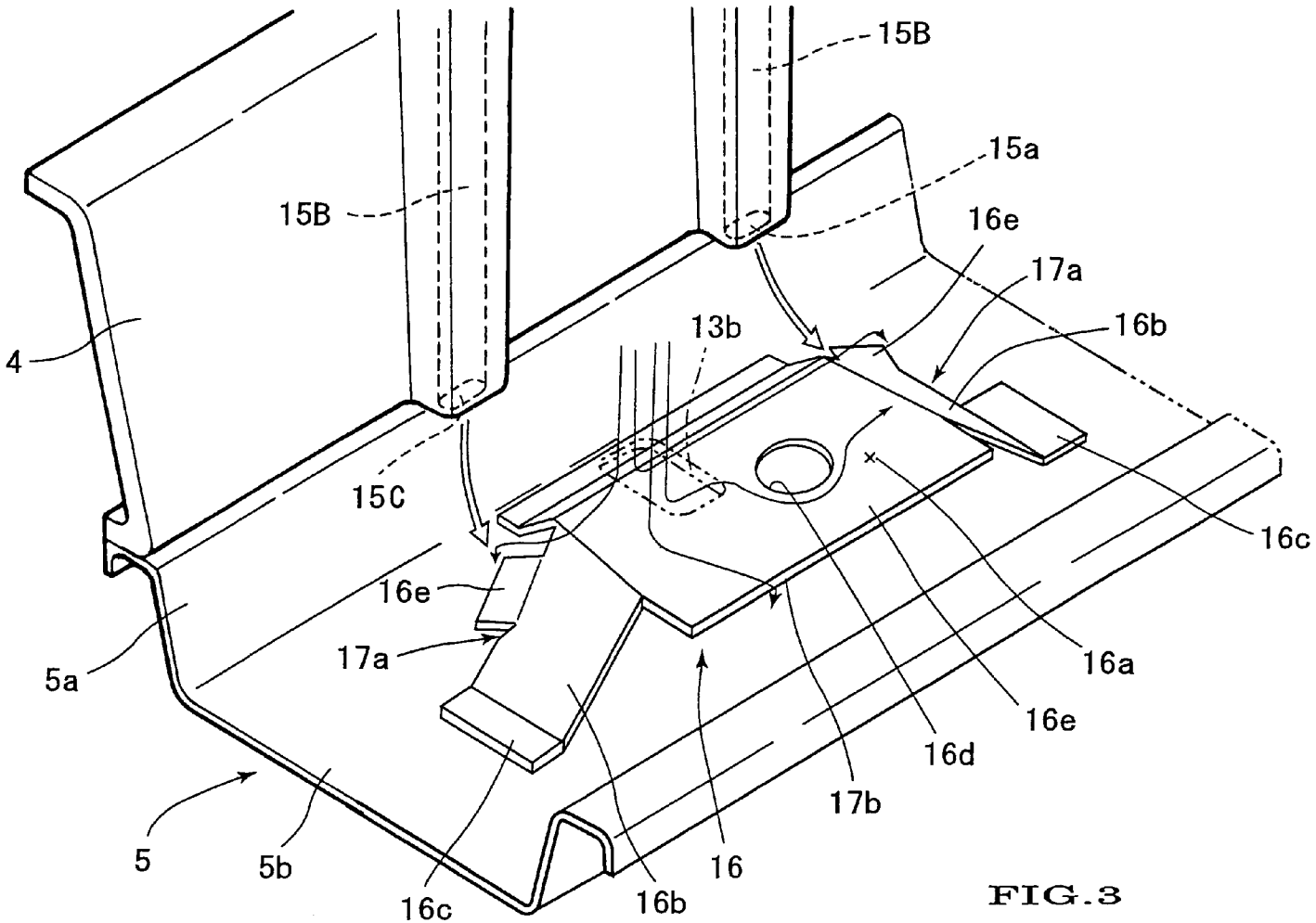
FIG. 3 is an enlarged perspective view of major portions showing a modification of the oil introducing portion.

FIG. 3 shows a modification of the oil introducing portion 16. The oil introducing portion 16 of FIG. 3, has sheet-like jaw portions 16*e* formed above the opening portions 17*a* and 17*b* so that they project toward the side wall 5*a* of the oil pan 5.

By providing these jaw portions 16*e* on the top end of the respective opening portions 17*a* and 17*b*, hot oil can flow along the oil introducing plate 16*a* over a longer distance so as to be introduced to the side wall 5*a* of the oil pan 5. Further, the flow speed of oil flowing toward the side wall 5*a* of the oil pan 5 can be accelerated. While the oil flows from the side wall 5*a* to the bottom wall 5*b*, heat is radiated to the atmosphere so that the oil is cooled excellently. Further, the oil retaining zone within the oil pan 5 can be eliminated excellently.

What is claimed is:

1. An oil pan mounted on a bottom part of a crank case of an internal combustion engine, the internal combustion engine including a first oil return passage extending from a cylinder head to an oil pan through a crank case and a baffle plate disposed at a bottom of the crank case, and a second oil return passage extending directly from the cylinder head to the oil pan, wherein:

the oil pan collects oil returned from said first oil return passage and oil returned from said second oil return passage;

the oil pan comprises an oil introducing means;

said oil introducing means comprises:

an oil introducing plate having an insertion hole for receiving a sucking portion of an oil strainer, the oil introducing plate extending from the periphery of said insertion hole toward a side wall of the oil pan, wherein the oil returned from said first oil return passage is introduced to flow along said oil introducing plate via an oil falling hole formed in said baffle plate:

a plurality of inclined wall portions mounted on a bottom portion of the oil pan in the vicinity of the side wall of the oil pan in order to support said oil introducing plate; and opening portions formed between the inclined wall portions and said bottom portion of the oil pan, wherein the oil introducing plate of the oil introducing means is located just below said oil falling hole formed in said baffle plate.

2. The oil pan according to claim 1, wherein said oil introducing means further includes sheet-like extensions extending from said inclined wall portions at respective top ends of said opening portions.

3. The oil pan according to claim 2, wherein said second oil return passage is open at a bottom end that is submerged in the oil collected within the oil pan; and a part of each of said opening portions is open toward the bottom end of said second oil return passage.

4. The oil pan according to claim 1, wherein said second oil return passage is open at a bottom end that is submerged in the oil collected within the oil pan; and a part of each of said opening portions is open toward the bottom end of said second oil return passage.

* * * * *